United States Patent [19]

Wadina

[11] 3,989,244

[45] Nov. 2, 1976

[54] POOL GUIDE AIMING AND TEACHING DEVICE

[76] Inventor: Donald P. Wadina, 644 S. 69th St., Milwaukee, Wis. 53214

[22] Filed: Mar. 12, 1975

[21] Appl. No.: 557,620

Related U.S. Application Data

[63] Continuation-in-part of Ser. No. 482,418, June 24, 1974, abandoned, which is a continuation-in-part of Ser. No. 341,467, March 15, 1973, abandoned.

[52] U.S. Cl. ..... 273/14

[51] Int. Cl.[2] ..... A63D 15/00

[58] Field of Search ..... 273/2, 3 R, 6, 8, 9, 273/14

[56] References Cited

UNITED STATES PATENTS

| | | | |
|---|---|---|---|
| 1,297,815 | 3/1919 | Englehart | 273/3 R |
| 1,610,620 | 12/1926 | Searle | 273/9 |
| 1,991,123 | 2/1935 | Seifert | 273/6 |
| 3,237,941 | 3/1966 | Vincent | 273/9 |
| 3,711,091 | 1/1973 | Dixon | 273/2 |

*Primary Examiner*—Richard C. Pinkham
*Assistant Examiner*—Marvin Siskind
*Attorney, Agent, or Firm*—Alter and Weiss

[57] ABSTRACT

A device to enable a pool player to pre-determine the direction to drive a cue ball in order to contact an object ball and drive the object ball in a pocket of a pool table. A plurality of mirrors are vertically disposed about a flat surface, and a combined cue ball direction and location magnetized simulation device is positionable on and viewable from anywhere on the flat surface. By observing the reflections of the simulation device in the mirrors from the desired pocket or position, a pool player is able to determine the proper direction to strike the cue ball with the cue stick.

8 Claims, 5 Drawing Figures

POOL GUIDE AIMING AND TEACHING DEVICE

This a continuation-in-part of my earlier filed patent application Ser. No. 482,418, filed June 24, 1974 and now abandoned; 482,418 is a continuation-in-part of 341,467 filed March 15, 1973 and now abandoned.

This invention relates to a pool teaching and aiming device and more particularly to a portable tool which may be used as an aiming device during a pool game at a normal pool table or a teaching device used while relaxing at home.

Billiards and pool are once again enjoying a great popularity surge as a recreational pastime. There is a large demand for tables for use in home, clubs, schools, churches, and other institutions as well as in taverns and billiard parlors. There are many variations and types of games which can be played, and the most difficult thing to master is banking. Banking is the art of driving a cue ball into one or more cushions before it strikes the object ball or driving the cue ball into the object ball which in turn is to strike one or more cushions before going into the desired pocket.

The inventive pool guide was developed as a teaching or aiming device to aid any player, experienced or not, to see what shots are possible before executing the actual shot. Towards this purpose, the device can analyze a shot with up to five or more banks.

Within minutes after reading the instructions, even a beginner should be able to make shots which would usually take a long time to learn. He will also be able to see the many other shots that he might not have noticed previously.

Since the invention relates to a tool for improving one's playing ability, it is important that it be easily portable, be usable with normal pool tables, and be simple and unobtrusive to other players. The inventive pool guide is designed to meet these criteria.

In using the pool guide, two variables might arise causing an appearance that the pool guide is not showing a player the right shot angle. These two variables are table quality, and cue ball English or spin. Quality of billiard table cushions vary greatly, and lower priced tables may not provide proper angles in banking. On lower quality tables the rebound angle will tend to flatten out (decrease) and the angle of approach should be increased slightly to compensate for it. Since the increase in the approach angle depends on the quality of the banks and the number of banks involved in the attempted shot, the user, after checking with the pool guide will take a few practice shots to determine alignment and get a feel for adjustment required to use the guide with that table. Most beginning players cannot hit a ball without imparting English. They may aim for the center of the cue ball, but when the stick is stroked, they hit off center. The pool guide is not intended to correct this kind of mistake and beginners should practice hitting the cue ball straight back and forth on the table, until the ball travels consistently over the same path.

Accordingly, an object of my invention is to provide a guide and teaching device which aids the user while relaxing at home or a participant in a game of pool to determine the direction to stroke the cue ball or object ball and to select the correct path to the desired pocket or position.

Another object of my invention is to provide a device of the character described that may be designed in appropriate miniaturized sizes and constructed for ease of portably carrying the unit about.

In keeping with an aspect of the invention, these and other objects are accomplished by providing a small mirror-lined replica of a pool table which may be carried about in a pocket of purse. The replica may be hand held and rest upon a surface away from the actual pool table or may be placed on or near and aligned with a pool table, with due regard to the banking angle deviations of poor quality cushions. A scale model of a cue ball, with a wedge-shaped viewing indicator attached, may be placed on the replica table in the same relative position as the cue ball on the playing table. By looking at the scale model cue ball image in a mirror from the pocket or position you want to direct the ball to, the indicator which can be sighted above the ball can be turned until this image points straight at you in line with the desired pocket or position, thus minimizing the amount of visiable indicator. The wedge-shaped member then indicates the direction of stroking on the playing table. If you desire to bank an object ball, use the indicator to simulate the object ball and drive the object ball in the direction shown by the indicator by hitting it with the cue ball. Reflected images in the various mirrors enable banking of a plurality of cushions.

In my invention, the scale model cue ball is preferably a hemispherical magnetic (or metal) unit, which is held in a fixed position to a metal plate (or magnetic surface) on the bottom of the replica table.

Other and further objects of my invention will become more apparent from the following description when taken in conjunction with the drawings, in which.

Figure 1:
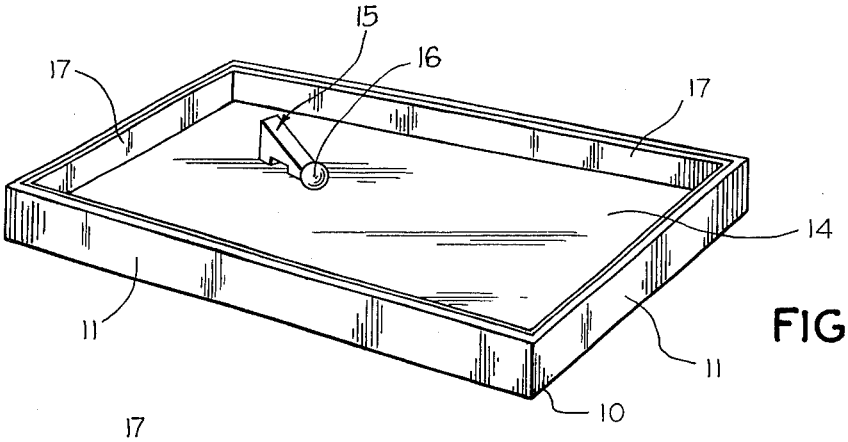
FIG. 1 is a perspective view of only one particular replica table design constituting my invention.
Figure 2:
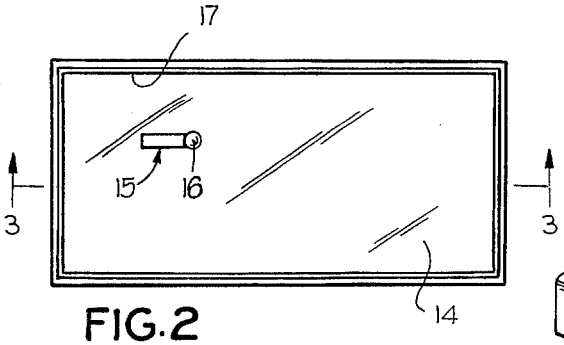
FIG. 2 is a top, or plan view of the replica table.
Figure 3:
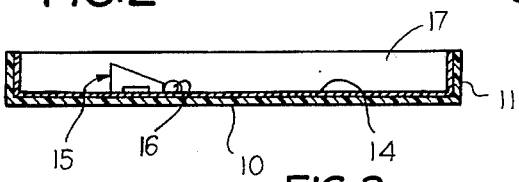
FIG. 3 is a longitudinal cross-sectional view of the replica table taken at the line 3—3 in FIG. 2.

Similar reference characters indicate corresponding parts and features, throughout the Figures. More particular, the character 10 identifies a rectangular construction plate, which may be of any suitable rigid material such as wood, metal, or plastic. Upwardly disposed sides 11 surround plate 10, slope slightly greater than 90° to the plane of the base of plate 10. The entire surface of the plate 10 is covered with a rectangular metal plate 14. The dimensions and proportions are such that the resulting structure substantially simulates a scale model of a pool table.

A combined direction and location indicator means, comprising a scale model cue ball and an elongated cue stick indicating, wedge-shaped longitudinal element 15, with an attached magnetic hemispherical or disk portion 16 which stands lower in height than the indicator, is adapted to be slidably moved on the metal plate 14. The scale model cue ball is placed in a pre-determined position, to correspond with the cue-ball 23 that is on the playing table. The elongated wedge-shaped element 15 is aligned in the direction of the pool cue 24 stroke, while playing the actual game (see FIG. 5). A scale model of an object ball (not shown) may also be provided. Essentially, the object ball is also a magnetic hemisphere or disk similar to cue ball 16, but without the cue stick indicator 15 attached.

A plurality of mirrors or other suitable reflector members 17 are juxtaposed along the inner surfaces of the sides 11 which angularly meet the surface cover 14. The purpose of the mirrors 17 is to reflect the image of the hemispherical or disk portion 16 and cue stick simulation 15, for alignment of the wedge-shaped longitudinal element 15, which is the scale model representation of the cue stick indicating the direction to drive the ball.

Figure 4:
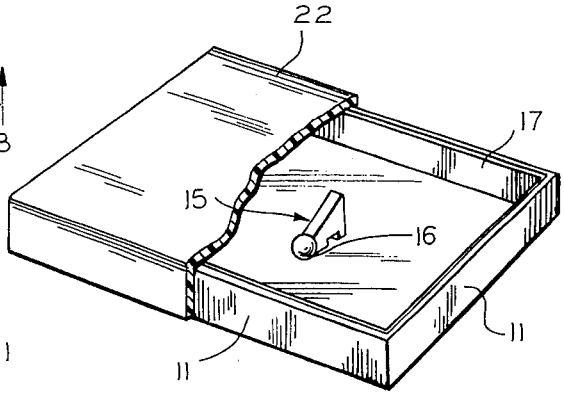
FIG. 4 is a fragmentary cross-sectional view of the replica table shown in FIG. 1, with a cover so it may be placed in a pocket or purse for easy transportation.

If desired, the entire replica table may be provided with a cover 22 (FIG. 4), which seals the unit while it is being carried in a pocket, or the like. The cover 22 may be attached to the replica table in any conventional manner. Preferably, cover 22 is either a snap-on cap or a slidable cover.

In operation or use, the element 16 of unit 15 is placed on the surface 14 at the indicated cue ball location, and the wedge-shaped longitudinal element 15 is rotated about element 16 to indicate the direction of cue stick aim. The person using the replica peeps over the side from the pocket position or object ball position which he wishes to hit and aligns the indicator means in a straight line relative to its reflection by minimizing the exposed portion of the indicator to its width. Since the user can easily see the scale model cue ball 16, he needs only to align the cue stick replica 15 image with the desired pocket or desired contact point on the object ball and his line of sight.

Then, all that the player has to do is to stroke the cue ball on the playing table in the direction indicated by the length of the wedge-shaped member 15.

Figure 5:
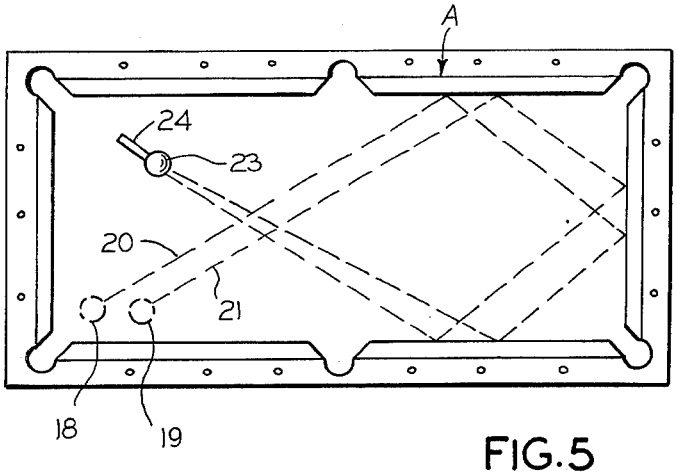
FIG. 5 is a schmematic layout of a playing table showing how the ball may be banked on the playing surface of the full size playing table.

On the representation of the actual pool table on which play is executed, FIG. 5, the balls 18 and 19 represent two randomly selected object balls lying on a conventional playing table of FIG. 5. The path of a cue ball is shown by the dashed lines 20 and 21, respectively, when stroked by cue stick 24. The object ball 18 is shown as about to be driven into the lower left corner pocket responsive to the cue ball travel over path 20. The object ball 19 will be hit on the right side and driven to the left into the lower left corner pocket. When the scale model cue ball 16 was aligned on the replica table, the player looking into the mirror toward point A (FIG. 5) from object ball 18 or 19 would have seen the image of the cue ball and rotated the indicator 15 to a point at object ball 18 or 19 as required. The player looking from over the side of the position of the upper middle pocket, would have seen images reflected from five sides along path 21 and the two additional bank shots not represented in FIG. 5.

From the above description it will become apparent that the purpose of my invention is to provide an easily portable miniaturized device that makes it possible to place the indicator 15 anywhere on the surface 14, to simulate the cue ball location and the direction of contact with the cue stick 24 during the game. By observing the reflections of the element 16 and the angular position wedge-shaped longitudinal element 15 in the mirrors 17 from the pocket or object ball location, the player will be able to determine the direction the pool ball should take on the actual playing table after aligning element 15 with his line of sight.

The inventive device is not a pool table, but rather a miniaturized simulation preferably set up on the pool table and then removed or used elsewhere before the shot is taken. Its purpose is to give the player an indication of the best shot available for the cue ball and object ball.

Although I have shown a specific construction of the parts and features constituting my invention, changes may be made without affecting their operativeness. Therefore, the appended claims are to be construed to cover all equivalent structures which do not depart from the spirit or the scope of my invention.

I claim:

1. A portable indicating device for predetermining the direction of linear course in which a pool ball should be driven during a game of pool comprising;

miniature playing surface means for simulating the surface of a pool table;

combined direction and location indicator means movable over said miniaturized simulated playing surface means;

side wall means extending around said playing surface means;

reflector means extending along and juxtaposed onto said side walls;

said direction and indicator means being reflected from the side wall by said reflector means, and said direction and indicator means having means greater in height than the height of said pool ball so as to enable the sighting of said direction and indicator means when viewed as an image from said reflector means, whereby the direction indicator means may be aligned to indicate the proper direction said pool ball should be driven by viewing the reflection of said direction and location indicator means on said reflector means from an object point on said surface means, and aligning said indicator means in a straight line attitude relative to its reflection.

2. The device of claim 1 wherein said simulated playing surface is a rectangular magnetic plate.

3. The device of claim 1 wherein said reflector means includes a plurality of mirrors adjacent said side walls of said simulated playing surface means.

4. The device of claim 1 wherein said miniaturized simulated pool guide aiming and teaching device is capable of being enclosed by a covering means and is of a size so as to enable portable movement through placement in pockets and purses.

5. A device for pre-determining the direction of a cue stick stroke of a first ball toward other balls used in a game of pool or billards, said device comprising a rectangular shaped plate, sides around the periphery of said plate, said sides extending upwardly from and at an angle slightly greater than 90 degrees to the plane of said plate, a plurality of mirrors affixed to the interior surfaces of said sides and an indicator means movably held by magnetic forces at any desired location on said plate, said indicator means being reflected by said plurality of mirrors when viewed from above a desired pocket position or object ball contact point and aligned longitudinally so as to indicate a direction of linear course movement of a ball relative to any one other ball or pocket.

6. The device of claim 5 wherein said indicator means includes an elongated longitudinal wedge-shaped portion affixed to a hemispherical cue ball simulating portion, and said indicator means slightly taller in height than said cue ball simulating portion so as to be visably recognizable above said cue ball simulating portion when viewed as an image on said reflector sides.

7. A portable indicating device for pre-determining the direction of linear course in which a pool ball should be driven during a game of pool, comprising;

miniature playing surface means for simulating the surface of a pool table;

combined direction and location indicator means movable over said miniaturized simulated playing surface means;

said combined direction and location indicator means comprising a longitudinal element, and a magnetic hemispherical cue ball simulation means rigidly affixed to said longitudinal element;

side wall means extending around said playing surface means;

reflector means extending along and juxtaposed onto said side walls;

said direction and indicator means being reflected from the side wall by said reflector means, and said direction and indicator means having means so as to enable its sighting when viewed as an image from said reflector means, whereby the direction indicator means may be aligned to indicate the proper direction such pool ball should be driven by viewing the reflection of said direction and location indicator means on said reflector means from an object point on said surface means, and aligning said indicator means in a straight line attitude relative to its reflection.

8. A portable indicating device for pre-determining the direction of linear course in which a pool ball should be driven during a game of pool, comprising;

miniature playing surface means for simulating the surface of a pool table;

combined direction and location indicator means movable over said miniaturized simulated playing surface means;

said wall means extending around said playing surface means;

reflector means extending along and juxtaposed onto said side walls;

said direction and indicator means being reflected from the side walls by said reflector means, said direction and indicator means having means so as to enable its sighting when viewed as an image from said reflector means, whereby the direction indicator means may be aligned to indicate the proper direction said pool ball should be driven by viewing the reflection of said direction and location indicator means on said reflector means from an object point on said surface means, and aligning said indicator means in a straight line attitude relative to its reflection, and said means to enable sighting of said direction and indicator means comprising an elongated and longitudinal member in the shape of a wedge and a hemispherical cue ball simulation rigidly affixed to said longitudinal element, said longitudinal member being slightly higher than said hemispherical cue ball simulation so as to enable recognition of said direction and indicator means as visibly protruding above the top of said hemispherical cue ball simulation.

* * * * *